US007854561B1

(12) United States Patent
Ammons et al.

(10) Patent No.: US 7,854,561 B1
(45) Date of Patent: Dec. 21, 2010

(54) TWO PIECE DRIP CONTAINING LID

(75) Inventors: James Ammons, 1420 Lawrence Rd., Kemah, TX (US) 77565; Ronald Allan Ammons, Livingston, TX (US)

(73) Assignee: James Ammons, Kemah, TX (US)

( * ) Notice: Subject to any disclaimer, the term of this patent is extended or adjusted under 35 U.S.C. 154(b) by 0 days.

(21) Appl. No.: 12/617,445

(22) Filed: Nov. 12, 2009

Related U.S. Application Data

(63) Continuation-in-part of application No. 12/544,953, filed on Aug. 20, 2009.

(51) Int. Cl.

| | |
|---|---|
| ***A46B 17/08*** | (2006.01) |
| ***A46B 11/00*** | (2006.01) |
| ***A45D 33/00*** | (2006.01) |
| ***A47G 19/00*** | (2006.01) |
| ***B65D 21/02*** | (2006.01) |
| ***B65D 25/00*** | (2006.01) |
| ***B65D 1/40*** | (2006.01) |
| ***B65D 3/28*** | (2006.01) |
| ***B05C 17/00*** | (2006.01) |
| ***B44D 3/00*** | (2006.01) |
| ***B44D 3/04*** | (2006.01) |

(52) U.S. Cl. ..... 401/122; 401/121; 401/126; 401/130; 220/23.9; 220/733; 220/919; 206/1.7; 206/1.8; 206/1.9

(58) Field of Classification Search ..... 401/121, 401/122, 126, 130; 206/1.7, 1.8, 1.9, 81; 220/23.87, 23.9, 273, 495.01, 495.02, 510, 220/571.1, 630, 733, 919, 780
See application file for complete search history.

(56) References Cited

U.S. PATENT DOCUMENTS

| | | | | |
|---|---|---|---|---|
| 332,043 | A | 12/1885 | Brien | |
| 1,696,240 | A | 12/1928 | Kircher, Jr. | |
| 2,313,059 | A | 3/1943 | Freeman | |
| 3,326,409 | A | 6/1967 | Speer | |
| 3,329,307 | A * | 7/1967 | Jacobson | 220/695 |
| D321,325 | S * | 11/1991 | Petrus | D9/435 |
| 5,573,340 | A * | 11/1996 | Gueret | 401/126 |
| 5,577,632 | A | 11/1996 | Blanchette et al. | |
| 5,662,242 | A * | 9/1997 | Steo | 220/695 |
| 5,779,093 | A | 7/1998 | Poole et al. | |
| 7,040,509 | B2 * | 5/2006 | McLelland et al. | 222/109 |
| 7,150,378 | B2 | 12/2006 | Dean et al. | |
| 2007/0102435 | A1 | 5/2007 | Fera | |
| 2009/0092436 | A1 | 4/2009 | Mercier | |

* cited by examiner

*Primary Examiner*—Gregory L Huson
*Assistant Examiner*—Ryan A Varnum
(74) *Attorney, Agent, or Firm*—Buskop Law Group, PC; Wendy Buskop

(57) ABSTRACT

Removable two piece drip containing lids for sealing one or more liquid holding container having a neck and a neck opening are provided. The removable two piece drip containing lid can include a wiper lid portion having a central opening and a cap portion. The wiper lid portion can include a wiper housing for engaging the outside of the neck; an extension secured to an inner portion of the wiper housing; a wiper connected to at least a portion of the extension. The cap portion can be connected to the wiper lid portion. The cap portion can include an applicator cap; a stem connected to the applicator cap and an applicator connected to the stem.

16 Claims, 8 Drawing Sheets

TWO PIECE DRIP CONTAINING LID

CROSS REFERENCE TO RELATED APPLICATIONS

The present application is a Continuation in Part application which claims priority and the benefit of co-pending U.S. patent application Ser. No. 12/544,953 filed Aug. 20, 2009, entitled "DRIP CONTAINING ONE-PIECE CONTAINER". This application is incorporated herein in its entirety.

FIELD

The invention generally relates to a removable two piece drip containing lid for sealing a liquid holding container having a neck and a neck opening.

BACKGROUND

A need exists for a container that prevents dripping and spilling of fast curing liquid adhesive which can be made by an easy metal stamping process with one stamp.

A need exists to prevent spilling of fast curing liquid adhesives or paints that can leak toxic emissions into the environment due to dripping and spilling of these liquids and materials.

A further need exists for a wiper formed in a container that enables the reduction of pollution because of a reduced need to replace the liquid and/or container because of spillage.

The present embodiments meet these needs.

BRIEF DESCRIPTION OF THE DRAWINGS

The detailed description will be better understood in conjunction with the accompanying drawings as follows.

Figure 1:
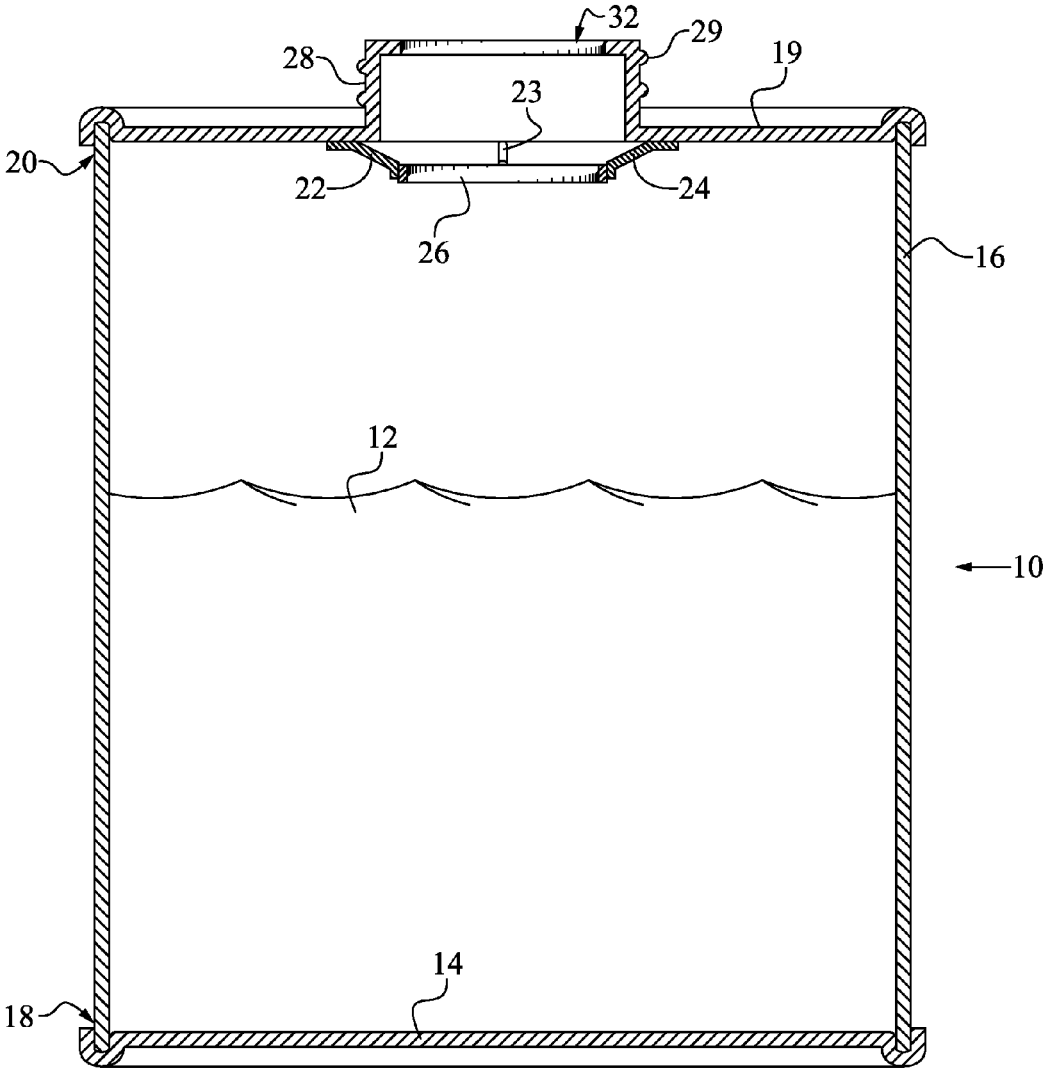
FIG. 1 depicts a side cut view of a drip containing container.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a removable two piece drip containing lid for sealing a liquid holding container having a neck and a neck opening.

In an embodiment, the liquid holding container can store or hold a liquid. The liquid can be an adhesive. For example, the liquid can be an epoxy for a fast curing liquid adhesive paint or a similar liquid adhesive such as used to install carpets.

Volatile organic chemicals or VOC's can be stored in the liquid holding container, which can reduce the toxic emissions into the environment.

The novel removable two piece drip containing lid can be used with the liquid holding container to reduce chemical clean up costs, since fewer containers will need to be replaced, reducing the carbon footprint of a user.

The removable two piece drip containing lid can be used to seal the liquid holding container. The liquid holding container can have a neck and a neck opening.

The removable two piece drip containing lid can have a wiper lid portion and a cap portion connectable to the wiper lid portion. The wiper lid portion or the cap portion can be made from a lightweight metal, such as aluminum and bimetal. In one or more embodiments, the wiper lid portion can be made from a material that is different from the martial of the cap portion.

In one or more embodiments, the wiper lid portion and/or the cap portion can be made from a reinforced polymer. The polymer can include a crystalline homopolymer and copolymers of polypropylene, crystalline homopolymers and copolymers of polyethylene, polyvinyl chloride, or combinations thereof.

In one or more embodiments, the wiper lid portion can have a central opening. The wiper lid portion can also have a wiper housing for engaging the outside of the neck; an extension secured to an inner portion of the wiper housing; and a wiper connected to at least a portion of the extension.

The wiper lid portion can include one, two, three, four, ten, twenty, or any number of extensions. In one or more embodiments, the wiper lid portion can have two extensions secured to the inner portion of the wiper housing, and the wiper can be disposed between the extensions.

The wiper housing can have threads and/or other connection devices allowing the wiper housing to secure to the neck of the liquid holding container. For example, the wiper housing can threadably engage the neck of the liquid holding container.

In one or more embodiments, the wiper can be a ring secured between two or more extensions. The ring can be made from a metal, a plastic, a laminate of metal, or combinations thereof. The wiper can be made from a material different from the material that the cap portion and the wiper lid portion are made from. Accordingly, the two part removable two piece drip containing lid can have at least three different physical properties simultaneously.

In one or more embodiments, a plurality of extensions can be secured to the inner portion of the wiper lid portion, and the wiper can be secured to each of or some of the extensions.

In one or more embodiments, at least two wipers can be used. The two wipers can be parallel to each other. The wipers can have one or more jagged teeth for grabbing the liquid.

In one or more embodiments, one or more extensions can have one or more perforations, which can allow for easy tearing off of the wiper from the at least one extension without the need for tools.

In one or more embodiments, one or more extensions and the wiper can have a thickness from about 1/64th inch to about ½ inch.

The cap portion can include an applicator cap; a stem connected to the applicator cap; and an applicator connected to the stem.

In one or more embodiments, the cap portion can removeably engage the wiper lid portion. For example, the wiper housing can have a wiper housing outer side and a wiper housing inner side, and threads can be formed on the wiper housing outer side for engaging the applicator cap. In one or more embodiments, the wiper housing can have one or more fasteners adapted to engage or secure to the cap portion, for example, the fasteners can be pressure clips. When the cap portion is engaged with the wiper lid portion a seal can be formed between the wiper lid portion and the cap portion.

The applicator can be sized to at least partially engage the wiper as the applicator is removed from the liquid containing container.

Turning now to the Figures, FIG. 1 shows a side cut view of an adhesive container.

The adhesive container can have a body 10 for holding a fast curing solvent welding liquid 12.

The body 10 can have a bottom 14 that can be connected to a wall 16. The wall 16 can have a cylindrical shape, as shown, or it can have a square shape, rectangular shape or another geometrical shape.

The wall 16 can have a first wall end 18 for engaging the bottom 14 and a second wall end 20 opposite the first wall end 18.

The adhesive container can have a top 19. The top 19 can connect to the second wall end 20 opposite the bottom 14.

A neck 28 can extend from the top 19. The neck 28 can have a neck opening 32 that can allow the fast curing solvent welding liquid 12 to flow from the adhesive container. The neck 28 can also have neck threads 29.

Extensions 22, 23 and 24 can be seen extending from the top 19 and neck 28. The extensions 22, 23 and 24 can engage a wiper 26.

The wiper 26 can have a ring shape, as depicted, a square shape, a rectangular shape, or another geometrical shape. In an embodiment, the wiper 26 can be hollow.

Figure 2:
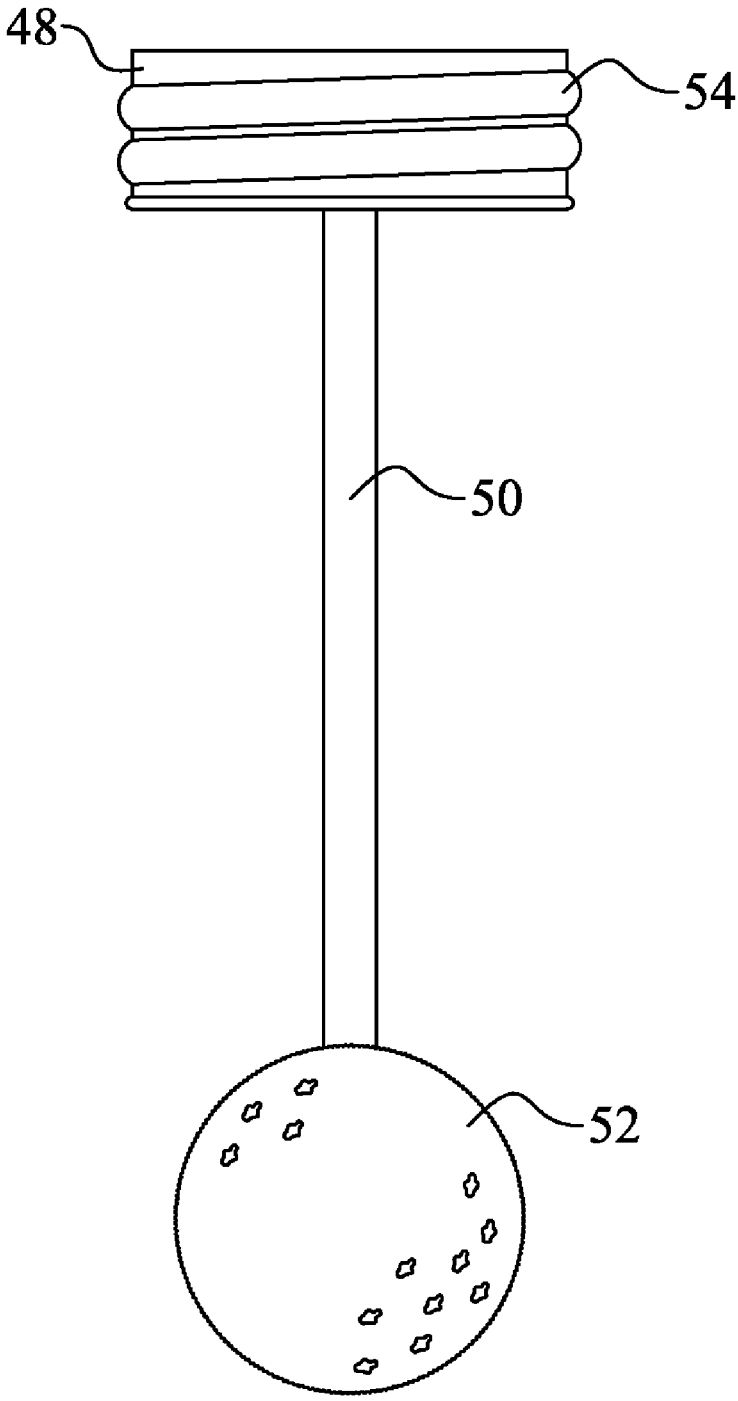
FIG. 2 depicts a side view of a cap portion.

FIG. 2 shows a side view of a dauber cap 48. Referring to FIGS. 1 and 2, the dauber cap 48 can have dauber cap threads 54 for creating a sealing engagement with the neck threads 29, as shown in FIG. 1.

A stem 50 can extend from the dauber cap 48, and an applicator 52 can be connected to the stem 50 opposite the dauber cap 48.

The applicator 52 can retrieve a portion of the fast curing solvent welding liquid 12, as shown in FIG. 1, through at least one of the openings 32, 34, 36 and 38, which will be described in later Figures. The wiper 26 can remove portions of the fast curing solvent welding liquid 12, allowing the fast curing solvent welding liquid 12 to fall back into the body 10 of the drip adhesive container. This can prevent the removed portions of the fast curing solvent welding liquid 12 from dripping externally to the adhesive container.

The applicator 52 and the stem 50 can be stored within the adhesive container when not in use.

Figure 3:
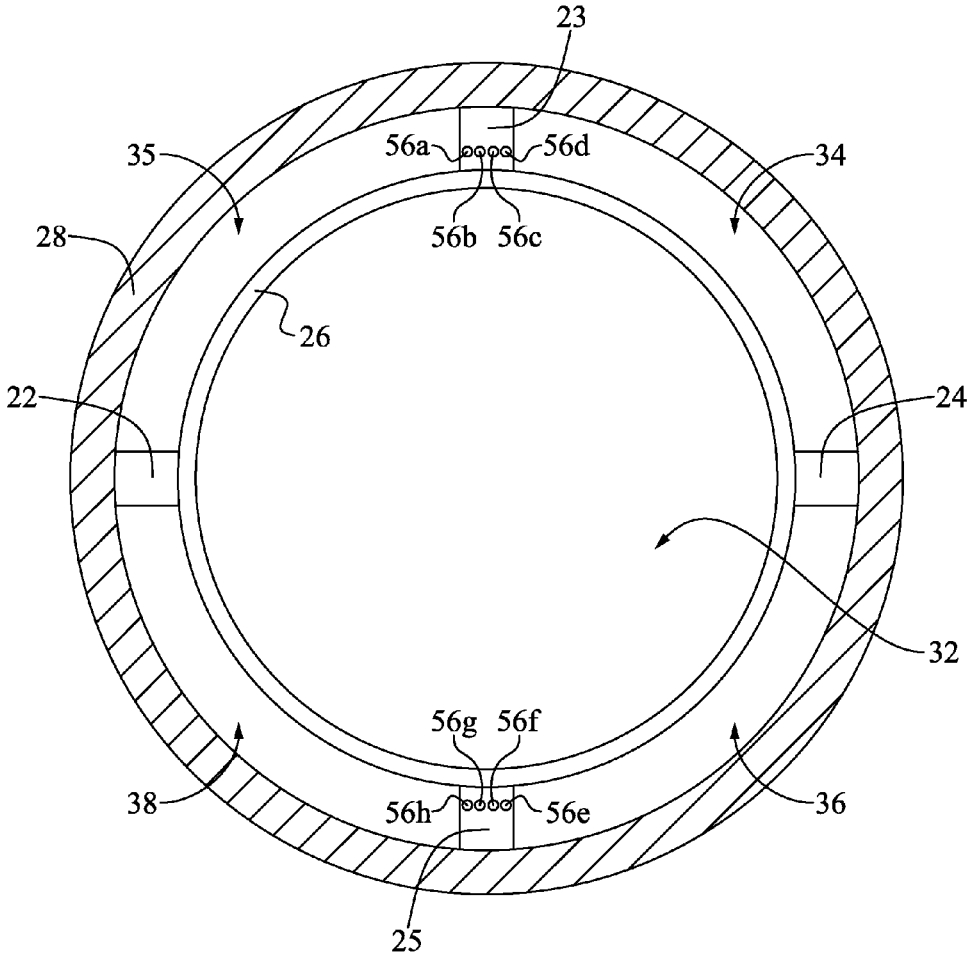
FIG. 3 shows a top cut view of a neck of the drip containing container of FIG. 1 with a wiper.

FIG. 3 shows a top cut view of the neck 28.

Extensions 22, 23, 24 and 25 can be seen engaging the wiper 26 forming openings 35, 35, 36 and 38. The opening can be used to extract liquid from the adhesive container. The central opening 32 can also be used to extract the liquid from the adhesive container.

The wiper 26 and the extensions 22, 23, 24, and 25 can permit the applicator to rest external to the fast curing solvent welding liquid without dripping externally to the drip containing container, when not in use.

While perforations **56*a*-56*h* are depicted in the extensions 23 and 25, each of the extensions 22, 23, 24, and 25 can have at least one perforation. The perforations can allow for easy tearing off of the wiper 26** from the drip containing container without the need for tools.

Figure 4:
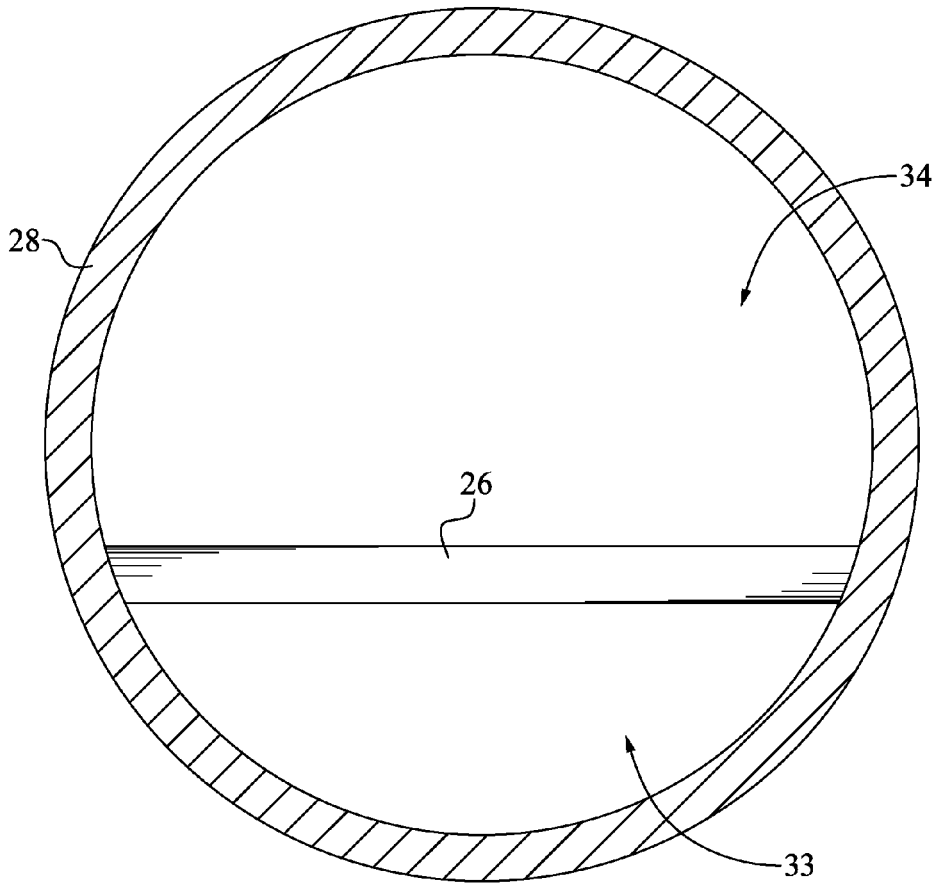
FIG. 4 shows a top cut view of the neck of the drip containing container of FIG. 1 with another illustrative wiper.

FIG. 4 shows a top cut view of the neck 28 with an alternative embodiment of the wiper 26. In this embodiment, the wiper 26 is shown as a single bar shaped element stretching across the neck 28.

The neck opening 32 can be divided into a first opening 34 and a second opening 33 by the wiper 26, as shown in FIG. 4.

Figure 5:
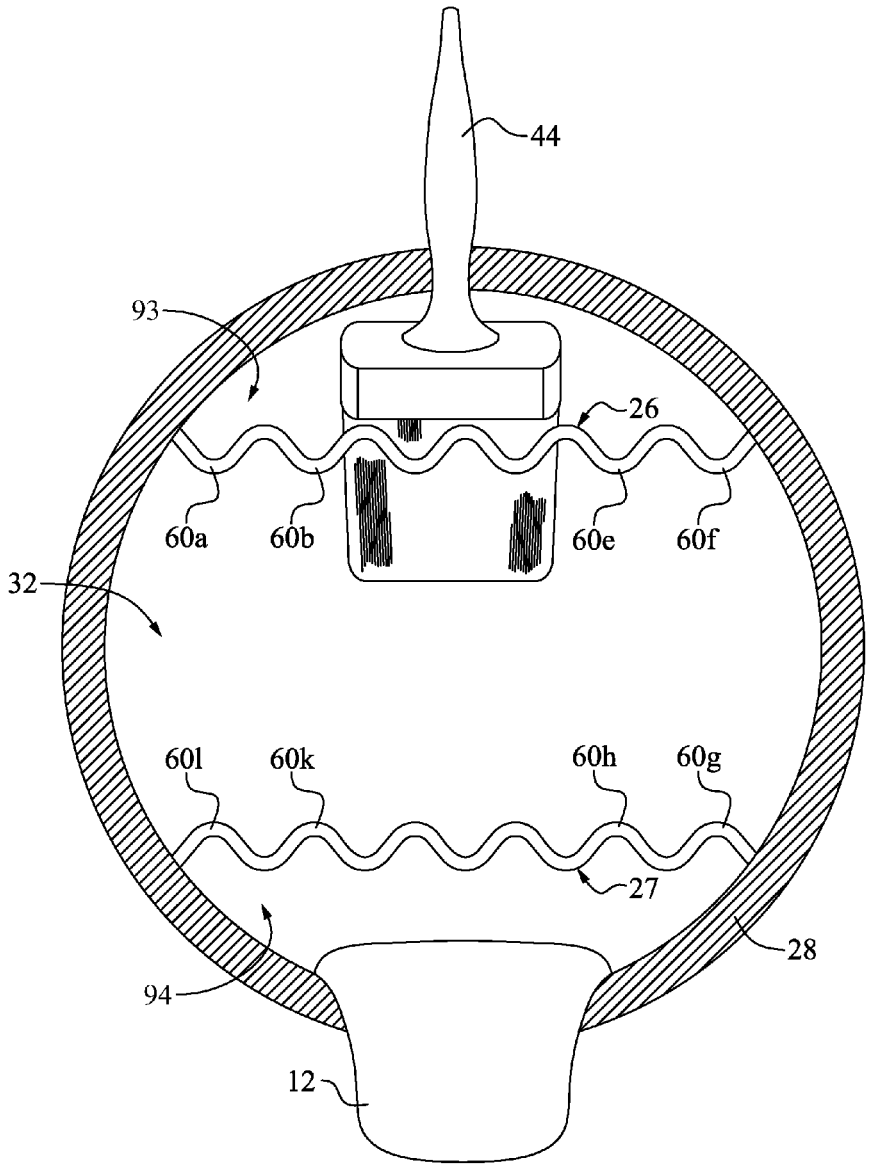
FIG. 5 shows a top cut view of the neck of the drip containing container of FIG. 1 with two wipers.

FIG. 5 shows a top cut view of the neck 28 with two wipers. In this embodiment, two wipers 26 and 27 are shown stretching across the neck 28. The two wipers 26 and 27 can be in parallel with each other.

The two wipers 26 and 27 can have a plurality of jagged teeth **60*a*-60*l* for grabbing the fast curing solvent welding liquid 12**.

The wipers 26 and 27 can separate the neck opening 32 opening or spaces 33 and 34.

The adhesive can be removed from the container via the neck opening 32, openings 33 and 34. For example, a brush 44 can be used to remove the adhesive 12 or the adhesive 12 can be poured trough one or more of the opening 32, 33, and 34.

In FIG. 5, the fast curing solvent welding liquid 12 can be seen being poured out of the adhesive container through the opening 34.

Figure 6:
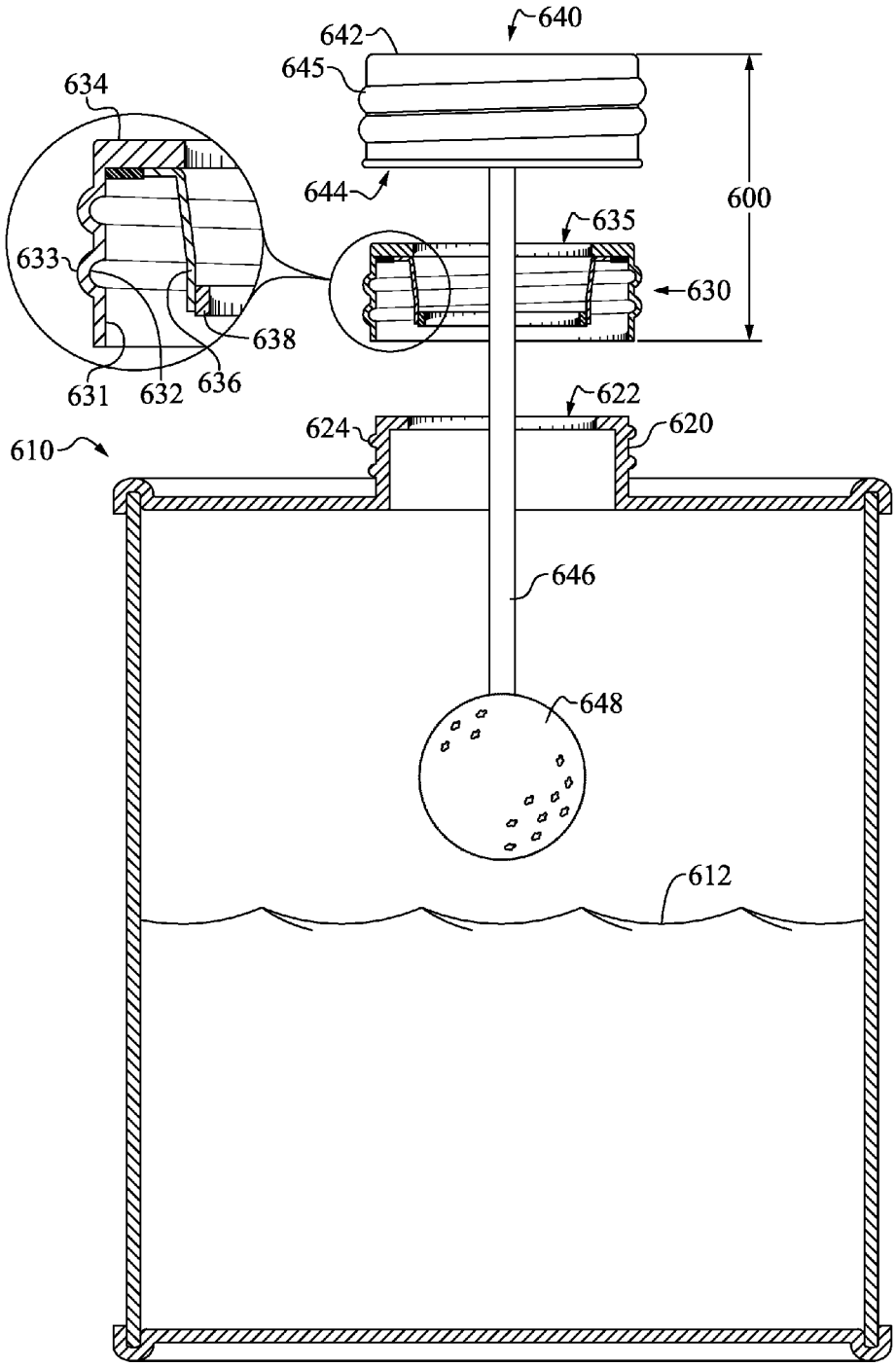
FIG. 6 depicts a removable two piece drip containing lid for sealing a liquid holding container.

FIG. 6 depicts a removable two piece drip containing lid 600 for sealing a liquid holding container 610 having a neck 620. The neck 620 can have a neck opening 622. The liquid holding container 610 can have a liquid 612 disposed therein. The liquid can be a paint, an adhesive, an epoxy, or any other liquid. The removable two piece drip containing lid 600 can include a wiper lid portion 630 and a cap portion 640. The wiper lid portion 630 and/or the cap portion 640 can be made from a lightweight metal selected from the group consisting of aluminum and bimetal. In one or more embodiments, the wiper lid portion can be made from a material different from a material of the cap portion.

In one or more embodiments, the wiper lid portion 630 and/or the cap portion 640 can be made from a reinforced polymer. The reinforced polymer can include crystalline homopolymer and copolymers of polypropylene, crystalline homopolymers and copolymers of polyethylene, polyvinyl chloride, or combinations thereof.

The wiper lid portion 630 can have a wiper housing 634. The wiper housing 634 can be configured to engage the neck 620. For example, the wiper housing 634 can have threads 632 located on an inner portion 631 thereof, and the threads 632 can engage threads 624 located on the neck 620. In one or more embodiments, the inner portion 631 of the wiper housing 634 can be replaced with another locking mechanism configured to engage a compliant locking mechanism on the neck 620. For example, the inner portion 631 of the wiper housing 634 can be a male portion of a clip and the female portion of the clip can be disposed or secured about the neck 620, and the male portion can be inserted into the female portion and locked in place securing the wiper housing 634 to the liquid holding container 610.

The wiper housing 634 can have a central opening 635. The central opening 635 can be configured to receive a portion of the cap portion 640. One or more extensions 636 can be located adjacent the central opening 632 and can be secured to at least an upper portion of the inner portion 631 of the wiper housing 634. The extensions 636 can extend away from the upper portion of the inner portion 631 of the wiper housing 634 towards a lower portion of the inner portion 631 of the wiper housing 634. The extensions 636 can extend from the upper portion of the inner portion 631 and slightly angle in towards the center of the central opening 635. In one or more embodiments, one or more of the extensions 636 can extend perpendicularly from the upper portion of the inner portion 631.

A wiper 638 can be similar to any wiper, such as those disclosed herein. The wiper 638 can be at least partially connected to at least one of the extensions 636. The wiper 638 can be connected to one or more of the extensions 636 by welding, a releasable tab, or other connecting or fastening device. In one or more embodiments, the wiper 638 can be a ring. The wiper 638 can be made from a metal, a plastic, a laminate of metal, or combinations thereof. In one or more embodiments, the wiper 638, the cap portion 640, and wiper lid portion 630 can be made from different materials. Accordingly, the two part removable two piece drip containing lid 700 can have at least three different physical properties simultaneously.

The cap portion 640 can include an applicator cap 642, a stem 646, and an applicator 648.

The applicator cap 642 can be disposed about the wiper housing 634. When the applicator cap 642 is disposed about the wiper housing 634, the applicator cap 642 can releasably secure to the wiper housing 634. For example, the applicator cap 642 can have threads 645 formed in the interior 644 thereof, and the threads 645 can threadably connect to one or more threads 633 formed on the exterior of the wiper housing 634.

The stem 646 can be connected to at least a portion of the interior 644 of the applicator cap 642. The stem 646 can extend from the applicator cap 642 away from the top of the applicator cap 642 and can at least partially protrude from the interior 644 of the applicator cap 642. The length of the stem 646 can be such that the stem 646 at least partially extends into the liquid holding container 610 when the applicator cap 642 is secured to the wiper housing 634.

The applicator 648 can be connected to the stem 646 at an end opposite the applicator cap 642. The applicator 648 can be similar to any one described herein. For example, the applicator 648 can be a brush, a sponge, or any other applicator capable of applying liquid 612 from the liquid container 610 to an item or items. The applicator 648 can be configured to slidably engage at least a portion of the wiper 638.

Figure 7:
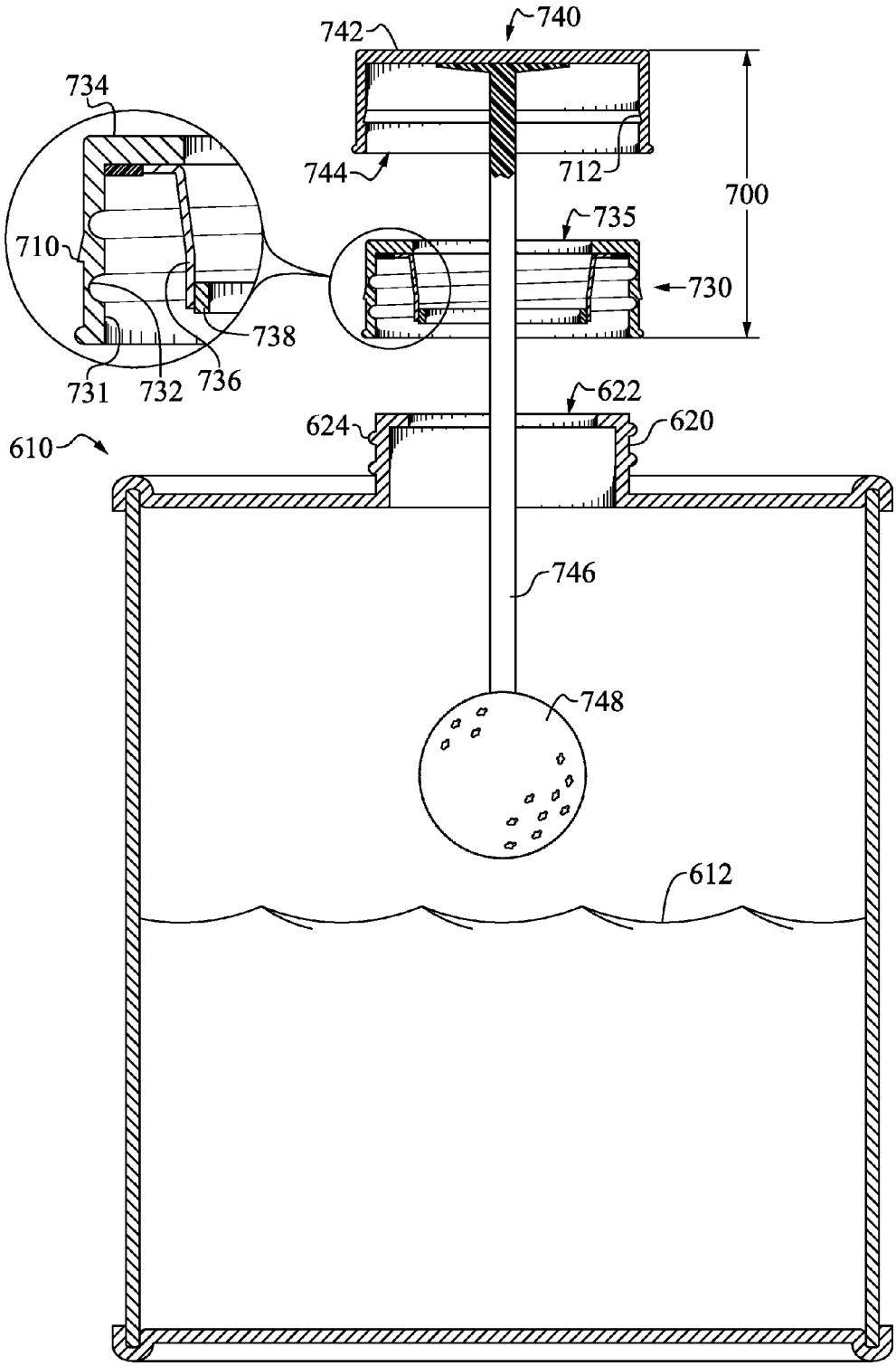
FIG. 7 depicts another illustrative removable two piece drip containing lid for sealing a liquid holding container.

FIG. 7 depicts another illustrative removable two piece drip containing lid 700 for sealing a liquid holding container 610. The two piece drip containing lid 700 can include a wiper portion 730 and a cap portion 740.

The cap portion 740 can include an applicator cap 742, a stem 746, and an applicator 748. The stem 746 and the applicator 748 can be similar to the ones described herein. The applicator cap 742 can have an interior 744. One or more snap latches 712 can be formed on or connected to the interior 744 of the applicator cap 742.

The wiper portion 730 can include a wiper housing 734, one or more extensions 736 secured to the interior 731 of the wiper housing 734, a central opening 735, one or more threads 732 formed into the interior 731 of the wiper housing 734, and a wiper 738. Accordingly, the wiper portion 730 can be substantially similar to the wiper portion described in FIG. 6; however, the wiper housing 734 can have one or more notches 710 formed on the exterior thereof in lieu of threads. Accordingly, the snap latch 712 can be engaged with or secured to the notches 710 and can connect or secure the cap portion 740 to the wiper lid portion 730.

Figure 8A:
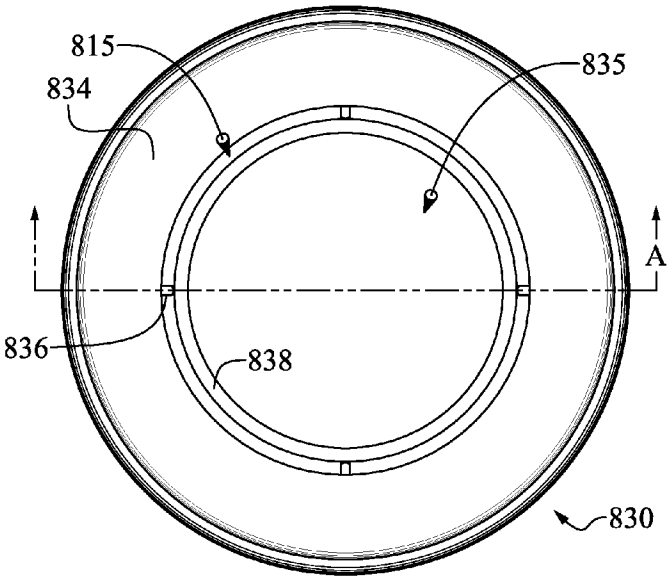
FIG. 8A depicts a top view of a wiper lid portion.
Figure 8B:
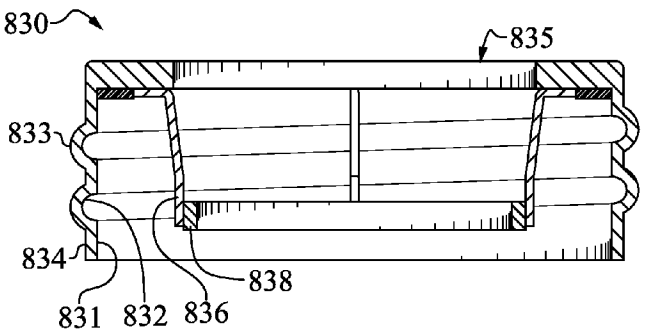
FIG. 8B depicts a side view of the wiper lid portion of FIG. 8A.

FIG. 8A depicts a top view of a wiper lid portion 830. FIG. 8B depicts a side view of the wiper lib portion 830 of FIG. 8A. Referring to FIGS. 8A and 8B, the wiper lid portion 830 can include a wiper housing 834. The wiper housing 834 can have a central opening 835 formed therethrough and one or more threads 833 formed on the exterior thereof. The wiper housing 834 can have a wiper 838 at least partially disposed therein. One or more extensions 836 can be connected to an interior 831 of the wiper housing 834 and one or more threads 832 can be formed into the interior 831. Accordingly, the wiper lid portion 830 can function similarly to one or more of the wiper lid portions described herein. A void or space 815 can be formed between the wiper 838 and the interior 831 of the wiper housing 834.

Figure 9A:
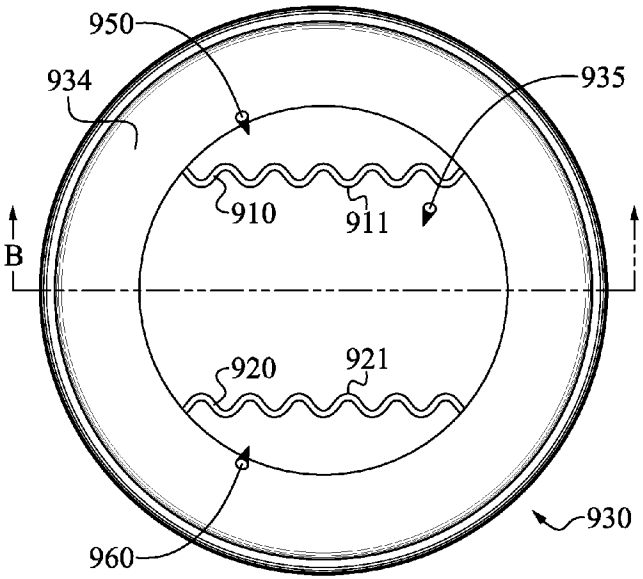
FIG. 9A depicts a top view of an illustrative wiper lid portion.
Figure 9B:
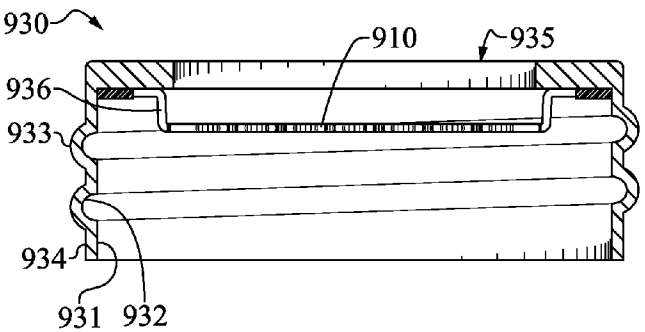
FIG. 9B depicts a side view of the wiper lid portion of FIG. 9A.

FIG. 9A depicts a top view of an illustrative wiper lid portion 930. FIG. 9B depicts a side view of the wiper lid portion 930 of FIG. 9A. Referring to FIGS. 9A and 9B, the wiper lid portion 930 can include a wiper housing 934. The wiper housing 934 can have a central opening 935 formed therethrough and one or more threads 933 formed on the exterior thereof. The wiper housing 934 can have a first wiper 910 and a second wiper 920 at least partially disposed therein. One or more extensions 936 can be connected to an interior 931 of the wiper housing 934. One or more threads 932 can be formed into the interior 931. Accordingly, the wiper lid portion 930 can function similarly to one or more of the wiper lid portions described herein. A first void or space 950 can be formed between the first wiper 910 and the interior 931 of the wiper housing 934 and a second void or space 960 can be formed between the second wiper 920 and the interior 931. Liquid can be poured through the first void 950 and the second void 960.

The first wiper 910 and the second wiper 920 can be secured to one or more extensions 936. The first wiper 910 and the second wiper 920 can be wires, plastic, rubber, metal, or similar materials. The first wiper 910 and the second wiper 920 can be similar to other wipers described herein. The first wiper 910 and the second wiper 920 can be connected to the same extension 936 or extensions 936 or to different extensions 936. The first wiper 910 and the second wiper 920 can be parallel to one another. In one or more embodiment, the first wiper 910 can have one or more first jagged teeth 911, and the second wiper 920 can have one or more second jagged teeth 921.

While these embodiments have been described with emphasis on the embodiments, it should be understood that within the scope of the appended claims, the embodiments might be practiced other than as specifically described herein.

What is claimed is:

1. A removable two piece drip containing lid for sealing a liquid holding container having a neck and a neck opening, wherein the removable two piece drip containing lid comprises:

a. a wiper lid portion having a central opening, wherein the wiper lid portion comprises:
   (i) a wiper housing for engaging an outside of the neck;
   (ii) an extension secured to an inner portion of the wiper housing; and
   (iii) a wiper connected to at least a portion of the extension, wherein the extension comprises at least one perforation allowing for easy tearing off of the wiper from the extension without the need for tools; and b. a cap portion connectable to the wiper lid portion, wherein the cap portion comprises:
   (i) an applicator cap;
   (ii) a stem connected to the applicator cap; and
   (iii) an applicator connected to the stem.

2. The removable two piece drip containing lid of claim 1, wherein the wiper housing threadably engages the neck of the liquid holding container.

3. The removable two piece drip containing lid of claim 2, wherein the wiper housing comprises a wiper housing outer side and a wiper housing inner side, and wherein threads are formed on the wiper housing outer side for engaging the applicator cap.

4. The removable two piece drip containing lid of claim 1, further comprising an additional extension secured to the inner portion of the wiper housing, and wherein the wiper is secured between the extension and the additional extension.

5. The removable two piece drip containing lid of claim 1, wherein the wiper housing engages the cap portion with fastening means and provides a seal therebetween.

6. The removable two piece drip containing lid of claim 5, wherein the fastening means are snap on fasteners or pressure clips.

7. The removable two piece drip containing lid of claim 1, wherein the applicator is configured to slidably engage at least a portion of the wiper.

8. The removable two piece drip containing lid of claim 1, wherein the cap portion removeably engages the wiper lid portion.

9. The removable two piece drip containing lid of claim 1, wherein at least one of the wiper lid portion or the cap portion comprises a lightweight metal selected from the group consisting of aluminum and bimetal.

10. The removable two piece drip containing lid of claim 9, wherein the wiper lid portion comprises a material different from the cap portion.

11. The removable two piece drip containing lid of claim 9, wherein the wiper comprises a material different from the cap portion and the wiper lid portion, allowing the removable two piece drip containing lid to have at least three different physical properties simultaneously.

12. The removable two piece drip containing lid of claim 9, wherein the wiper lid portion or the cap portion is made from a reinforced polymer selected from the group consisting of: a crystalline homopolymer and copolymers of polypropylene, crystalline homopolymers and copolymers of polyethylene, polyvinyl chloride, and combinations thereof.

13. The removable two piece drip containing lid of claim 1, further comprising a plurality of extensions secured to the inner portion of the wiper housing, wherein the wiper is secured to the plurality of extensions.

14. The removable two piece drip containing lid of claim 1, wherein at least two wipers are used with the extension, and wherein the at least two wipers are parallel to each other.

15. The removable two piece drip containing lid of claim 14, wherein the at least two wipers each have a plurality of jagged teeth for grabbing the liquid.

16. The removable two piece drip containing lid of claim 1, wherein the extension and the wiper have a thickness of between 1/64th inch to 1/2 inch.

* * * * *